US008153252B2

(12) United States Patent
Lee

(10) Patent No.: US 8,153,252 B2
(45) Date of Patent: Apr. 10, 2012

(54) INDUSTRIAL HIGH TENACITY POLYESTER FIBER WITH SUPERIOR CREEP PROPERTIES AND THE MANUFACTURE THEREOF

(75) Inventor: Young-Soo Lee, Cheongju-shi (KR)

(73) Assignee: Kolon Industries, Inc, Kwacheon (KR)

( * ) Notice: Subject to any disclaimer, the term of this patent is extended or adjusted under 35 U.S.C. 154(b) by 106 days.

(21) Appl. No.: 12/741,474

(22) PCT Filed: Nov. 10, 2008

(86) PCT No.: PCT/KR2008/006613

§ 371 (c)(1),
(2), (4) Date: May 5, 2010

(87) PCT Pub. No.: WO2009/061161

PCT Pub. Date: May 14, 2009

(65) Prior Publication Data

US 2010/0261868 A1 Oct. 14, 2010

(30) Foreign Application Priority Data

Nov. 9, 2007 (KR) ..... 10-2007-0114407
Nov. 10, 2008 (KR) ..... 10-2008-0110993

(51) Int. Cl.
*D02G 3/00* (2006.01)

(52) U.S. Cl. ..... 428/364; 428/395

(58) Field of Classification Search ..... 428/364, 428/395

See application file for complete search history.

(56) References Cited

U.S. PATENT DOCUMENTS

| | | | | |
|---|---|---|---|---|
| 3,616,832 | A * | 11/1971 | Shima et al. | 152/527 |
| 4,101,525 | A | 7/1978 | Davis et al. | |
| 4,389,839 | A * | 6/1983 | van der Werff | 57/238 |
| 4,690,866 | A | 9/1987 | Kumakawa et al. | |
| 5,547,627 | A | 8/1996 | Tanaka et al. | |
| 5,558,935 | A * | 9/1996 | Tanaka et al. | 428/364 |
| 5,891,567 | A | 4/1999 | Kim et al. | |
| 6,759,123 | B2 | 7/2004 | Jeong et al. | |
| 7,198,843 | B2 | 4/2007 | Kim et al. | |
| 2010/0261868 | A1 * | 10/2010 | Lee | 528/271 |

FOREIGN PATENT DOCUMENTS

KR 10-2007-0016469 A 2/2007

* cited by examiner

*Primary Examiner* — N. Edwards
(74) *Attorney, Agent, or Firm* — Sughrue Mion, PLLC

(57) ABSTRACT

The present invention relates to an industrial high tenacity polyester fiber with superior creep properties and a method of preparing the same, and more particularly to an industrial polyester fiber having a mono-filament fineness of 5 to 15 dpf, an intrinsic viscosity of 0.8 to 1.25 dl/g, and a creep change rate of 4.7% or less, wherein the creep change rate is measured at 160° C. for 24 hours while giving a load corresponding to a strain of 3% after heat-treating the fiber at 220° C. for 2 minutes while giving a load of 1 g/d, and the load corresponding to the strain of 3% is based on a value obtained from a load-strain curve of the fiber before heat-treatment, and a method of preparing the same.

8 Claims, 2 Drawing Sheets

INDUSTRIAL HIGH TENACITY POLYESTER FIBER WITH SUPERIOR CREEP PROPERTIES AND THE MANUFACTURE THEREOF

CROSS REFERENCE TO RELATED APPLICATIONS

This application is a National Stage of International Application No. PCT/KR2008/006613 filed Nov. 10, 2008, claiming priority based on Korean Patent Application Nos. 10-2007-0114407 and 10-2008-0110993, filed Nov. 9, 2007 and Nov. 10, 2008 respectively, the contents of all of which are incorporated herein by reference in their entirety.

BACKGROUND OF THE INVENTION (a) Field of the Invention

The present invention relates to a high tenacity industrial polyester fiber and a method of preparing the same, and more particularly to an industrial high tenacity polyester fiber with a superior creep property and that can have various industrial uses including as a tire cord for reinforcing rubber, and for a seat belt, a conveyor belt, a V-belt, a rope, a hose, and the like, and a method of preparing the same.

(b) Description of the Related Art

In order to prepare a fiber, a high tenacity fiber is generally prepared by changing various process parameters, such as a spinning temperature, a quench air temperature, a temperature of godet rollers and a velocity ratio thereof, and the like. Particularly, a method of minimizing orientation of an undrawn fiber before drawing process is used in the preparing process of an industrial polyester fiber so as to reveal the properties in the fiber-making processes (synthesis of raw materials, polymerization, and spinning).

However, there is a limitation of applying the fiber to a real manufacturing process, because it is difficult to reveal the properties and the quality and the processibility thereof deteriorate when the orientation of the undrawn fiber increases.

This is caused by the characteristics of the polyester polymer itself, and a conventional polyester fiber shows a tenacity property of 9.3 g/d or less. Therefore, developments for optimizing properties while equally maintaining the quality and processibility of the industrial polyester fiber are ongoing.

As an example, U.S. Pat. No. 4,690,866 suggested a spinning method using polyester chips having a high intrinsic viscosity (IV) of 1.2 or more as a method for increasing the tenacity of a polyester multi-filament fiber. In this way, when the intrinsic viscosity of the chips is raised, the spinning tension increases and the orientation uniformity of the undrawn fiber and the formation of tie-chains connecting crystals increase, and thus it can show superior tenacity when the fiber is made into a final product. However, the polyester having high intrinsic viscosity used in the method has a large difference in intrinsic viscosities between the surface and the core when it is made by solid-state polymerization. When melt-spinning it, therefore, the spinnability deteriorates due to the heterogeneity of the viscosity, and the processibility and the appearance become inferior because of hairiness generated at the filaments. Furthermore, there is also a problem in that thermal degradation and hydrolysis are generated, and the spun fiber cannot actually have as much intrinsic viscosity as the chips have because it must be melt-spun at a high temperature.

Furthermore, when preparing the polyester fiber by using a usual spinning device, there are limitations in the qualities of fiber and the processibility for exhibiting the high tenacity of 9.5 g/d or more. Thus far, properties surpassing the target value (9.0 g/d) can be obtained by minimizing the orientation differences of undrawn fiber, but there is a difficulty in exhibiting properties beyond that because of the characteristics of the polymer.

SUMMARY OF THE INVENTION

Therefore, to resolve the problems of the prior arts, it is an aspect of the present invention to provide an industrial high tenacity polyester fiber with superior tenacity and shape stability by minimizing thermal degradation and hydrolysis by minimizing the spinning temperature, and a method of preparing the same.

In order to attain the object, the present invention provides an industrial polyester fiber having a mono-filament fineness of 5 to 15 dpf, an intrinsic viscosity of 0.8 to 1.25 dl/g, and a creep change rate of 4.7% or less, wherein the creep change rate is measured at 160° C. for 24 hours while giving a load corresponding to a strain of 3% after heat-treating the fiber at 220° C. for 2 minutes while giving a load of 1 g/d, and the load corresponding to the strain of 3% is based on a value obtained from a load-strain curve of the fiber before the heat-treatment.

The present invention also provides an industrial polyester fiber having a mono-filament fineness of 5 to 15 dpf, an intrinsic viscosity of 0.8 to 1.25 dl/g, and a creep change rate of 8% or less, wherein the creep change rate is measured at 160° C. for 24 hours while giving a load corresponding to a strain of 5% after heat-treating the fiber at 220° C. for 2 minutes while giving a load of 1 g/d, and the load corresponding to the strain of 5% is based on a value obtained from a load-strain curve of the fiber before the heat-treatment.

The present invention also provides a method of preparing an industrial high tenacity polyester fiber including the steps of discharging a polymer melt after melting polyester dry chips of which the residue of titanium dioxide is 150 to 500 ppm and the intrinsic viscosity is 1.05 to 1.25 dl/g, eliminating impurities by passing the discharged melt through a dispersing plate and a main filter that are installed in a spinning pack; and spinning the melt and drawing the same.

The present invention also provides a rope and a belt made of the polyester fiber.

EXPLANATIONS FOR SIGNS OF THE PRINCIPAL PARTS OF THE DRAWINGS

| | |
|---|---|
| 1: | lower part of spinning pack |
| 2: | oil-roll or oil jet |
| 3: | pre-interlacer |
| 4: | first godet roller |
| 5: | second godet roller |
| 6: | third godet roller |
| 7: | fourth godet roller |
| 8: | fifth godet roller |

-continued

| | |
|---|---|
| 9: | sixth godet roller |
| 10: | 2-step interlacer |
| 11: | winder |

DETAILED DESCRIPTION OF THE EMBODIMENTS

Hereinafter, the present invention is explained in more detail.

In order to prepare a high strength fiber, it is required that the main chain bond is strong, the conformation of the chain forms a straight line, or the number of end groups composing the molecular chain is minimized.

Among them, the present invention intends to reveal the development of superior strength by minimizing the number of end groups composing the molecular chain, and increasing the formation of tie-chains connecting between crystals.

Therefore, polyester dry (or solid-state) chips having an intrinsic viscosity of 0.9 dl/g or more, and preferably an intrinsic viscosity of 1.05 to 1.25 dl/g, are used in the present invention, and the chips are mixed while they pass through an extruder. Furthermore, the present invention has characteristics in that the polymer having passed through the extruder passes through a dispersing plate and a main filter, which are specifically designed for the spinning pack, and a hood heater directly under a spinning die, and then the undrawn fiber having passed through the hood heater is cooled by a cooling air stream, oiled with spinning oil, and drawn.

That is, the present invention can prevent congestion of a polymer stream by causing the intrinsic viscosity of the fiber finally prepared to have an optimum level, and can also prepare a high tenacity fiber having a tenacity of 9.5 g/d or more by using the solid-state polymerized polyester chips having the intrinsic viscosity of 0.9 dl/g or more, preferably 1.05 to 1.25 dl/g, and more preferably 1.1 to 1.25 dl/g, spinning the polyester undrawn fiber with the specifically designed spinning pack, and drawing the same with a high drawing ratio. The high tenacity polyester fiber prepared in this way can be appropriately applied to various industrial fibers.

For this, the present invention extends the time of solid-state polymerization and raises thermal efficiency thereof so as to use the polyester dry chips having the intrinsic viscosity of 0.9 dl/g or more, preferably 1.05 to 1.25 dl/g, and more preferably 1.1 to 1.25 dl/g. It is therefore possible to prepare a high tenacity polyester fiber having superior tenacity and shape stability to that of usual fibers, because the polymer chains are rigid.

Figure 1:
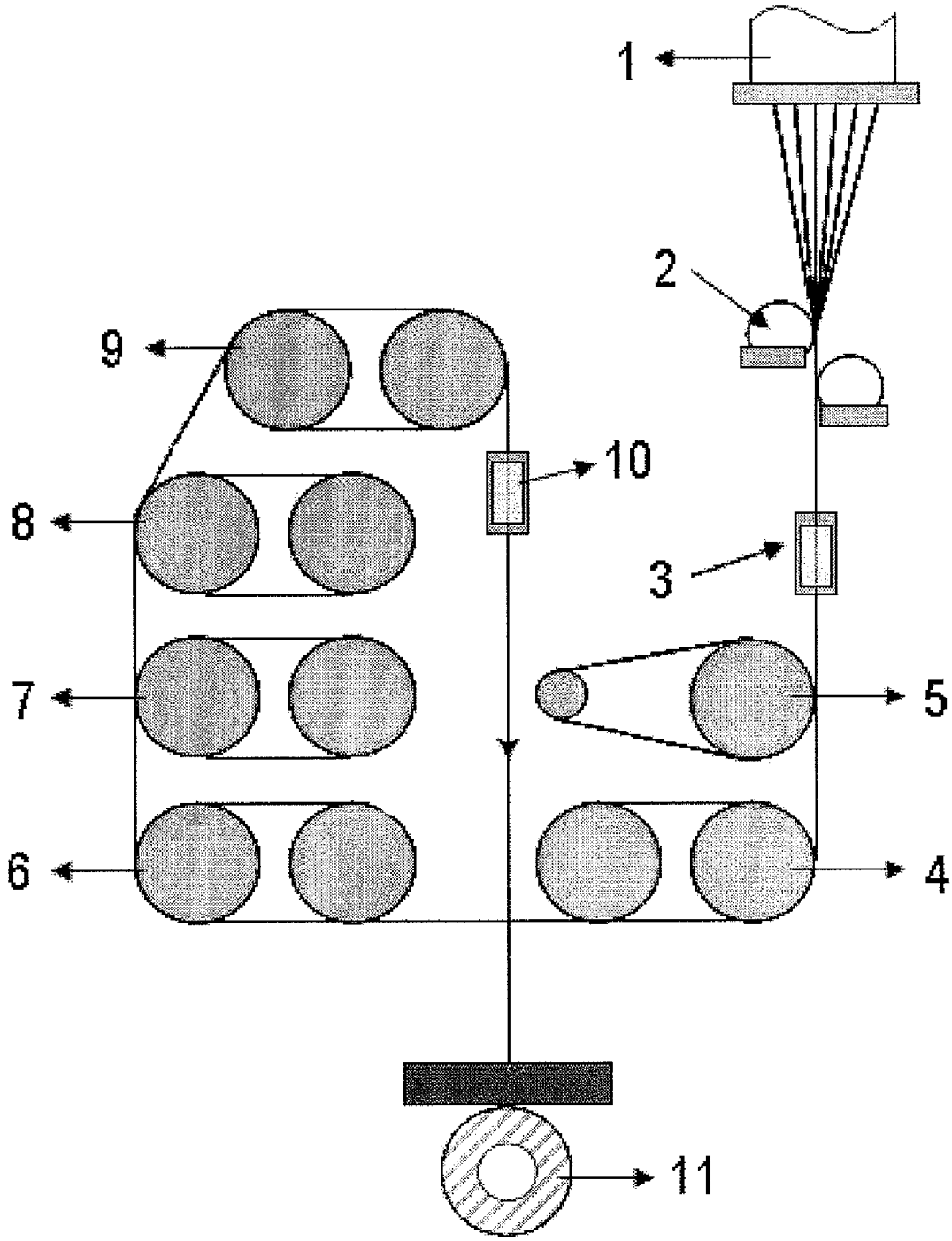
FIG. 1 is a schematic drawing of a device for preparing a high tenacity polyester fiber of the present invention.

Furthermore, the polyester fiber of the present invention can be prepared by using the device illustrated in FIG. 1. With this device, the pressure of the spinning pack and malignant residence space of the polymer can be minimized by changing the structure of the dispersing plate and the main filter that are components of the spinning pack of the present invention. That is, the usual method uses a metal powder as the dispersing plate and a residence time of about 1.5 times longer than the present dispersing plate, so the malignant residence section appears, but the present invention uses a non-woven filter as the dispersing plate and can minimize the length of the malignant residence space and the polymer path.

Furthermore, the present invention can produce a top-quality fiber quality by controlling spinning temperature, a hood heater, quench air temperature, and a speed difference between the godet rollers, and temperatures thereof.

The polyester prepared by this method reveals a minimum tenacity of 9.5 g/d or more and a maximum of about 10.2 g/d, and its dry heat shrinkage rate is 15% or less, and thus it is possible to prepare a fiber having superior properties.

Furthermore, the present invention may prepare a polyester fiber through the steps of controlling the mono-filament fineness of the drawn fiber to be 5 to 15 dpf by using a plurality of spinning dice, melt-spinning at a discharging amount of 300 g/min or more, and cooling, multi-step drawing, and winding the same. It is preferable that the mono-filament fineness of the drawn fiber is 5 to 14 dpf and that the discharging amount is 300 to 800 g/min.

The intrinsic viscosity of the polyester fiber finally obtained may be 0.8 to 1.25 dl/g, preferably 0.92 dl/g to 1.25 dl/g, and more preferably 0.95 to 1.05 dl/g.

Particularly, the polyester fiber of the present invention has a creep change rate of 4.7% or less, and preferably 2.5 to 4.7%, wherein the creep change rate is measured at an oven at 160° C. for 24 hours while giving a load corresponding to a strain of 3% after heat-treating the fiber at 220° C. for 2 minutes while giving a load of 1 g/d. The load corresponding to the strain of 3% is based on a value obtained from a load-strain curve of the fiber before heat-treatment.

The polyester fiber of the present invention also has a creep change rate of 8.0% or less, and preferably of 4 to 8%, wherein the creep change rate is measured at an oven at 160° C. for 24 hours while giving a load corresponding to a strain of 5% after heat-treating the fiber at 220° C. for 2 minutes while giving a load of 1 g/d. The load corresponding to the strain of 5% is based on a value obtained from a load-strain curve of the fiber before heat-treatment.

The fiber prepared by the above mentioned method, which satisfies a mono-filament fineness of 5 to 15 dpf, an intrinsic viscosity of 0.8 to 1.25 dl/g, and a prescribed creep change rate, has good strength properties, such as tensile strength and the like, and can show superior shape stability and excellent processibility.

Hereinafter, one embodiment of the method of preparing the high tenacity polyester fiber of the present invention is disclosed by referring to FIG. 1. However, the following method is merely an example of the present invention, and the following disclosure does not limit the range of the present invention.

FIG. 1 is a schematic drawing of a device for preparing a polyester fiber of the present invention.

Firstly, the present invention prepares polyester dry chips of which a residue of titanium dioxide ($TiO_2$) is 150 to 500 ppm and the intrinsic viscosity is 1.05 to 1.25 dl/g, preferably 1.05 to 1.25 dl/g, and more preferably 1.1 to 1.25 dl/g. Then, the chips are introduced into an extruder and melted to be a polymer melt under a nitrogen atmosphere so as to exclude external air. Thereafter, the polymer melt is discharged by using a gear pump that is designed to discharge the same at a fixed quantity. At this time, the discharged polymer melt successively passes through the specially designed spinning pack so as to eliminate impurities, the spinning die under a uniform pressure, and the hood heater and the heat insulating plate that are designed to exhibit the drawability of a target level. Furthermore, quench air is vertically provided to the fiber in the falling direction of the fiber so as to process the crystallization to an optimal level and produce the strength of the fiber.

Concretely, the present invention cools the melt polymer that is spun through the lower part of a spinning pack 1 of a die having a structure with circular holes with the quench air, and provides oil to the undrawn fiber through a device 2 of a single oil roll or oil jet, or a combination thereof, as illustrated in FIG. 1. The present invention then uniformly disperses the oil provided to the undrawn fiber to the surface of the fiber with a uniform air pressure by using a pre-interlacer 3 equipped with a dispersing plate and a main filter for eliminating impurities of the polymer. Following this, the present invention finally prepares a polyester fiber by passing the fiber through a multi-step drawing process by using godet rolls 4-9, intermingling the fibers at a 2-step interlacer 10 with a uniform pressure, and winding the same with a winder 11.

The present invention can provide a product that is advantageous in terms of heat setting and operation by adding an additional godet roller, and a pre-interlacer disperses the spinning oil on the surface of the fiber and can improve the drawability and quality and the 2-step interlacer is effective for improving the post-processibility by providing a cohesion property to the fiber.

Furthermore, the spinning speed may be 400~700 mpm, and when the spinning speed is below 400 mpm, it is impossible to produce a fiber having high shape stability and high modulus because the orientation factor of the undrawn fiber is low, and when the spinning speed is over 700 mpm, the orientation factor increases rapidly and the heterogeneity between the filaments composing the fiber occurs and the strength deteriorates.

It is preferable to draw the fiber with a high drawing ratio of a total drawing ratio of 5.0~7.0 times, and preferably of 5~6.5 times, when preparing the polyester fiber with the spinning speed through the multi-step drawing and heat treating processes. The relaxing ratio may be 1 to 5.0%, and may preferably be 1 to 3%. It is also preferable that the winding speed is 2500 m/mim or more, and it is more preferable that the winding speed is 2500 to 4000 m/mim.

Furthermore, it is preferable that the spinning is carried out under conditions of a spinning temperature of 260° C. or more, and preferably 260 to 300° C., a hood-heater temperature of 200 to 350° C., and a quench air speed of 0.3 m/sec or more, and preferably 0.3 to 1.0 m/sec.

As explained above, the fiber tenacity can be increased by 0.3 g/d or more even with an equal drawing ratio to that of the traditional method when preparing the fiber with the polyester chips having initial intrinsic viscosity of 0.9 dl/g or more, preferably 1.05~1.25 dl/g, and more preferably 1.1 to 1.25 dl/g in the present invention, and there is an advantage of reducing the number of fibers used in weaving in comparison with a traditional fiber when it is prepared into a final product. Furthermore, because the fiber according to the present invention has high tenacity, the tensile strength and the tear strength of the final product are also superior and there is an advantage of it not being damaged even when it is used for a long time.

Furthermore, the creep change rate is increased by about 20% or more when heat-treating of the polyester fiber occurs at 220° C. for 2 minutes while giving a load of 1 g/d, and then giving a load corresponding to a strain of 3%, which is based on the value obtained from the load-strain curve, at an oven of 160° C. for 24 hours in order to measure a creep property considering the post-process when preparing a final product by using the prepared fiber, and the creep change rate further increases as the load increases and there is an advantage in that the final product made of the fiber has good shape stability and it is possible to use the product for a long time.

The polyester fiber prepared by the present invention is superior in terms of creep change rate as well as strength, and it is possible to reduce the number of fibers used in weaving in comparison with a traditional fiber and to increase the tensile strength and tear strength of a final product due to its high strength when the same number of fibers are used therein, and the shape stability is good for a long time because of its low creep change rate.

Hereinafter, preferable examples of the present invention are disclosed. However, the following examples are merely preferable examples of the present invention and the present invention is not limited to or by them.

EXAMPLES 1-5 and COMPARATIVE EXAMPLES 1-2

Chips of the examples and comparative examples were prepared according to the solid-state polymerization conditions of the following Table 1, and then the polyester fibers were prepared according to the spinning conditions of the fibers by using the device according to FIG. 1.

TABLE 1

| | | Example 1 | Example 2 | Example 3 | Example 4 | Example 5 | Comparative Example 1 | Comparative Example 2 |
|---|---|---|---|---|---|---|---|---|
| Intrinsic viscosity of the chip (IV) | | 1.11 | 1.15 | 1.18 | 1.20 | 1.24 | 0.89 | 1.01 |
| Spinning conditions | Spinning temperature (° C.) | 296 | 296 | 298 | 298 | 300 | 288 | 292 |
| | Drawing ratio (times) | 5.63 | 5.58 | 5.53 | 5.5 | 5.48 | 5.64 | 5.6 |
| | Relaxing rate (%) | 2.05 | 2.02 | 1.99 | 1.96 | 2.10 | 2.05 | 2.03 |
| | Winding speed (m/mim) | 3160 | 3160 | 3160 | 3160 | 3160 | 3160 | 3160 |
| | Spinning speed (mpm) | 573 | 578 | 583 | 586 | 589 | 572 | 576 |
| | Hood heater temperature (° C.) | 300 | 300 | 300 | 300 | 300 | 300 | 300 |
| | Quench-air speed (m/sec) | 0.9 | 0.9 | 0.9 | 0.9 | 0.9 | 0.9 | 0.9 |

Experimental Example 1

(Measurement of Intrinsic Viscosity and Creep Change Rate)

Intrinsic viscosity and creep change rate of Examples 1-5 and Comparative Examples 1-2 were measured, and the results are listed in Table 2.

The intrinsic viscosity and creep change rate in Table 2 were measured according to the following methods.

(1) Intrinsic Viscosity (IV): after extracting spinning oil from a specimen with carbon tetrachloride and dissolving the specimen in orthochlorophenol (OCP) at 160±2° C., the viscosity of the specimen in a capillary was measured by using an automatic viscometer (Skyvis-4000) at a temperature of 25° C. and the intrinsic viscosity (IV) of the fiber was calculated according to the following Calculation Formulae.

Intrinsic Viscosity (IV)= $\{(0.0242\times Rel)+0.2634\}\times F$ [Calculation Formula 1]

Rel=(seconds of solution×specific gravity of solution×viscosity coefficient)/(OCP viscosity) [Calculation Formula 2]

$F$=(IV of the standard chip)/(average value of three IV measured from the standard chip with standard action) [Calculation Formula 3]

(2) Creep Change Rate (%)

The creep property shows data that can evaluate the shape stability by measuring the change of length of the fiber according to time when a certain load is granted to the fiber.

In order to measure the creep property of the present invention, the following samples were prepared and the properties were measured.

(Testing Method)

Regarding Examples 1-5 and Comparative Examples 1-2, the fibers were firstly heat-treated at 220° C. for 2 minutes while giving a load of 1 g/d considering the post-process conditions. The temperature of an oven that was used was adjusted to 160° C. in order to give a large creep change to the firstly heat-treated sample in a short time, a change of length was measured for 24 hours, and the creep change rate was calculated by the following Calculation Formula 4. At this time, the load was based on the load-strain curve, and loads corresponding to the strains of 3% and 5% were given to the fibers.

Creep Change Rate (%)=(finally changed length of specimen (mm)/length of specimen set in initial grip (mm))×100 [Calculation Formula 4]

Figure 2:
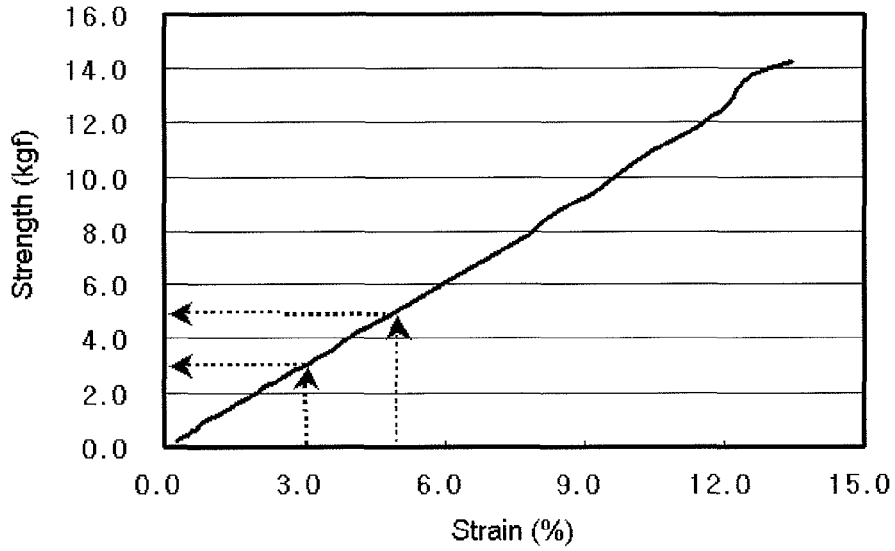
FIG. 2 is a graph showing the load-strain curve of the high tenacity industrial polyester fiber (1500 denier) according to Example 1 of the present invention.
Figure 3:
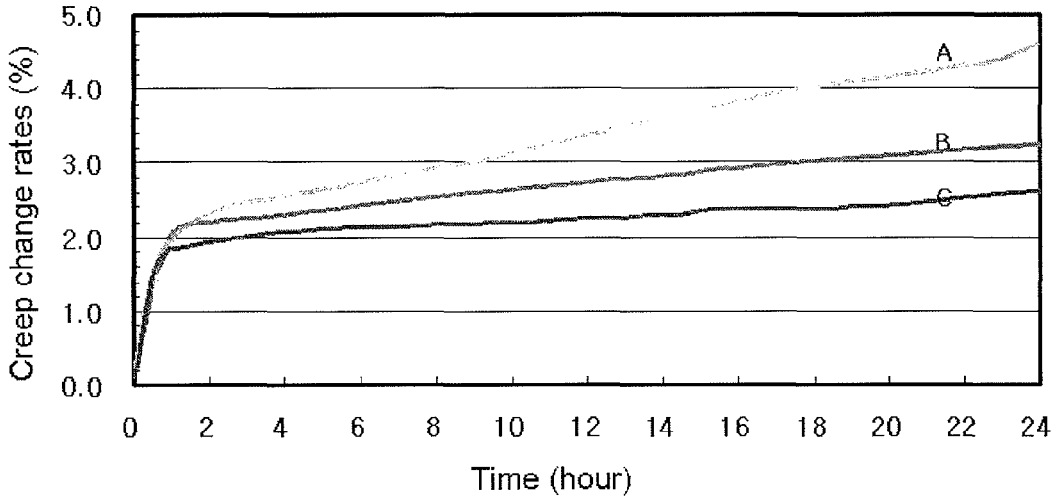
FIG. 3 is a graph showing the creep change rates of the industrial high tenacity polyester fiber according to Examples 1 and 3 and Comparative Example 2 of the present invention.

With regard to each polyester fiber 1500 De/120 F, the testing results of each creep change rate (%) when the loads of 3 kg and 5 kg corresponding to the strains of 3% and 5% were given are listed in Table 2. Among them, the values of the creep change rates regarding Examples 1 and 3 and Comparative Example 2 are illustrated in FIGS. 2 and 3. FIG. 2 is a graph showing the load-strain curve of the high tenacity industrial polyester fiber (1500 denier) having a superior creep property according to Example 1 of the present invention. Furthermore, FIG. 3 is a graph showing the creep change rates of the fibers according to Comparative Example 2 and Examples 1 and 3 when giving the load corresponding to a strain of 3%. In FIG. 3, "A" represents Comparative Example 2, "B" represents Example 1, and "C" represents Example 3.

TABLE 2

| | | Example 1 | Example 2 | Example 3 | Example 4 | Example 5 | Comparative Example 1 | Comparative Example 2 |
|---|---|---|---|---|---|---|---|---|
| Creep change rate (%) | 3 kg | 3.4 | 3.0 | 2.6 | 2.4 | 2.0 | 4.9 | 4.8 |
| | 5 kg | 5.4 | 4.8 | 4.1 | 4.0 | 3.8 | 12.2 | 8.1 |
| Intrinsic viscosity of the fiber (IV) | | 0.95 | 0.97 | 1.02 | 1.03 | 1.06 | 0.91 | 0.92 |

As shown in Table 2 and FIGS. 2 and 3, it is recognized that the creep change rate of the present invention is much less than that of the comparative examples when giving loads of 3 kg and 5 kg.

Experimental Example 2

(Measurements of Tensile Tenacity and Breaking Strain)

Tensile tenacity and breaking strain were measured with regard to Examples 1-5 and Comparative Examples 1-2, and the results are listed in Table 3. The tensile tenacity and the breaking strain represent values converted (ASTM D 885) from values of strength and displacement measured by using a universal testing machine (INSTRON).

Tenacity (g/d)= Strength (g)/Fineness of the fiber (De) [Calculation Formula 5]

Fineness of mono-filament (De')=Total fineness of the fiber/Number of the filaments [Calculation Formula 6]

Furthermore, the dry heat shrinkage rate is a value measured after leaving the fiber at 150° C. for 30 minutes. That is, the dry heat shrinkage rate is obtained by the method of selecting 40 fibers and measuring the length (L1) thereof while giving an initial load of ⅓ g/d, and then measuring the length (L2) after treating the fibers in an oven at 155° C. for 30 minutes.

Dry heat shrinkage rate (%)= $(L1-L2)/L1\times 100$ [Calculation Formula 7]

TABLE 3

| | Example 1 | Example 2 | Example 3 | Example 4 | Example 5 | Comparative Example 1 | Comparative Example 2 |
|---|---|---|---|---|---|---|---|
| Tensile tenacity (g/d) | 9.68 | 9.83 | 10.01 | 10.06 | 10.16 | 8.52 | 9.01 |
| Breaking strain (%) | 12.4 | 12.1 | 12 | 11.8 | 11.6 | 15.2 | 12.4 |
| Dry heat shrinkage rate (%) | 10.6 | 10.6 | 10.8 | 11 | 11.3 | 8.2 | 10.5 |

As shown in Table 3, it can be recognized that Examples 1 to 5 have a lesser creep change rate than the comparative examples and their tensile tenacities and breaking strains are equal to or superior than those of the comparative examples, and particularly their tensile tenacities are 9.5 g/d or more which is excellent. Furthermore, it is also recognized that their shape stabilities are good due to their low creep rate when they are applied to products.

The polyester fiber of the present invention has high tenacity and superior creep properties, and it can be applied to various industrial fibers such as a tire cord for reinforcing rubber, a belt, a rope, a hose, and the like.

What is claimed is:

1. An industrial polyester fiber, of which mono-filament fineness is 5 to 15 dpf, an intrinsic viscosity is 0.8 to 1.25 dl/g, and a creep change rate is 4.7% or less wherein the creep change rate is measured at 160° C. for 24 hours while giving a load corresponding to a strain of 3% after heat-treating the fiber at 220° C. for 2 minutes while giving a load of 1 g/d, and the load corresponding to the strain of 3% is based on a value obtained from a load-strain curve of the fiber before the heat-treatment.

2. The industrial polyester fiber according to claim 1, wherein the creep change rate is 2.5 to 4.7%.

3. The industrial polyester fiber according to claim 1, wherein the intrinsic viscosity of the polyester fiber is 0.95 to 1.05 dl/g.

4. An industrial polyester fiber, of which a mono-filament fineness is 5 to 15 dpf, an intrinsic viscosity is 0.8 to 1.25 dl/g, and a creep change rate is 8% or less wherein the creep change rate is measured at 160° C. for 24 hours while giving a load corresponding to a strain of 5% after heat-treating the fiber at 220° C. for 2 minutes with a load of 1 g/d, and the load corresponding to the strain of 5% is based on a value obtained from a load-strain curve of the fiber before the heat-treatment.

5. The industrial polyester fiber according to claim 4, wherein the creep change rate is 4 to 8%.

6. The industrial polyester fiber according to claim 4, wherein the intrinsic viscosity of the polyester fiber is 0.95 to 1.05 dl/g.

7. A rope prepared by using the polyester fiber according to claim 1.

8. A belt prepared by using the polyester fiber according to claim 1.

* * * * *